US011542765B2

(12) United States Patent
Coronado et al.

(10) Patent No.: US 11,542,765 B2
(45) Date of Patent: Jan. 3, 2023

(54) COMBINATION DOWNHOLE ASSEMBLY

(71) Applicant: The WellBoss Company, LLC, Houston, TX (US)

(72) Inventors: Martin P. Coronado, Fulshear, TX (US); Brian M. Gleason, Fort Worth, TX (US)

(73) Assignee: The WellBoss Company, LLC, Houston, TX (US)

( * ) Notice: Subject to any disclaimer, the term of this patent is extended or adjusted under 35 U.S.C. 154(b) by 0 days.

(21) Appl. No.: 17/391,205

(22) Filed: Aug. 2, 2021

(65) Prior Publication Data

US 2022/0034181 A1 Feb. 3, 2022

Related U.S. Application Data

(60) Provisional application No. 63/059,247, filed on Jul. 31, 2020, provisional application No. 63/059,233, filed on Jul. 31, 2020, provisional application No. 63/071,709, filed on Aug. 28, 2020.

(51) Int. Cl.
*E21B 23/04* (2006.01)

(52) U.S. Cl.
CPC .... *E21B 23/0414* (2020.05); *E21B 23/04115* (2020.05)

(58) Field of Classification Search
CPC ..... E21B 23/065; E21B 23/04; E21B 23/06; E21B 23/0414
See application file for complete search history.

(56) References Cited

U.S. PATENT DOCUMENTS

| | | | | |
|---|---|---|---|---|
| 2,229,635 | A * | 1/1941 | Boynton | E21B 49/088 73/152.28 |
| 3,094,166 | A * | 6/1963 | McCullough | E21B 23/065 166/123 |
| 5,396,951 | A | 3/1995 | Ross | |
| 9,810,035 | B1 | 11/2017 | Carr et al. | |
| 2019/0106956 | A1 | 4/2019 | Wells | |
| 2020/0018132 | A1* | 1/2020 | Ham | E21B 23/04 |
| 2020/0095838 | A1 | 3/2020 | Baker | |
| 2020/0115979 | A1* | 4/2020 | Mickey | E21B 23/065 |
| 2020/0362652 | A1* | 11/2020 | Eitschberger | E21B 23/06 |

FOREIGN PATENT DOCUMENTS

| | | |
|---|---|---|
| WO | 2016070187 | 5/2016 |

* cited by examiner

*Primary Examiner* — Kipp C Wallace
(74) *Attorney, Agent, or Firm* — Kearney, McWilliams & Davis, PLLC; John M. DeBoer

(57) ABSTRACT

A combination downhole assembly having a setting tool assembly coupled with a downhole tool. The setting tool assembly has an adapter housing configured to couple with a part of a workstring, and a power charge mandrel coupled with the adapter housing. There is a barrel piston releasably coupled with the power charge mandrel. During run-in, the barrel piston is in a first position. Upon activation of a setting sequence, the barrel piston moves to a second position. The setting sequence results in the barrel piston engaging a tension mandrel configured with a deceleration feature.

18 Claims, 8 Drawing Sheets

COMBINATION DOWNHOLE ASSEMBLY

STATEMENT REGARDING FEDERALLY SPONSORED RESEARCH OR DEVELOPMENT

Not applicable.

BACKGROUND

Field of the Disclosure

The present disclosure relates generally to a setting tool assembly apparatus and method for actuating various downhole tools. The setting tool assembly may be characterized as being disposable, single-use, reusable, or hybrid between partly disposable and reusable. The setting tool assembly may be pre-assembled with a downhole tool to form a combination downhole assembly.

Background of the Disclosure

An oil or gas well includes a wellbore extending into a subterranean formation at some depth below a surface (e.g., Earth's surface), and is usually lined with a tubular, such as casing, to add strength to the well.

During the construction, completion, recompletion, or work-over of a wellbore, there may be situations where one or more downhole tools may need to be actuated. FIG. 1 illustrates a conventional plugging system 100 that includes use of a downhole tool 102 used for plugging a section of a wellbore 106 drilled into formation 110. A tubular 108 (casing, casing string, etc.) is disposed in the wellbore 106. The tool or plug 102 may be lowered into the wellbore 106 (and within the tubular 108) by way of workstring 112 (e.g., e-line, wireline, coiled tubing, etc.) and/or with setting tool (assembly) 117, as applicable.

The tool may be a frac plug like the "Boss Hog" plug provided by The WellBoss Company, LLC of Houston, Tex., and as provided for in multiple patents, including U.S. Pat. No. 8,997,853, incorporated herein in its entirety for all purposes, including as it pertains to a frac plug and setting thereof. Other tools and tool configurations may be used.

The setting tool 117 can be incorporated into the workstring 112 along with the downhole tool 102 in a manner known to one of skill. Examples of commercial setting tools include the Baker #10 and #20, and the 'Owens Go'. Technological advances in downhole tool technology, particularly as it pertains to fracing, have allowed the United States to reshape the global energy economy. However, while downhole tool technology has advanced, innovation around setting tools used in connection with the downhole tools has lagged.

Thus, operators often use old, outdated setting tool technology, which has a detrimental impact (if not outright damage) on downhole tools of advanced complexity. This is particularly the case for modern wells that have significant (horizontal) deviation, as setting tools were originally designed and developed for use only in vertical orientation. Moreover, setting tools were not previously designed to account for impact on technologically advanced tools, particularly those that have electronics or other features ultra-sensitive to shock. Thus, dampening after tool disconnect is important because there is a chance to damage other components within the workstring (such as those uphole of the setting tool) during run-out or other motion of the workstring via motion of setting tool components.

A conventional method for actuating (setting) a downhole tool is to generate a pressurized gas using a pyrotechnic (or power) charge of a setting tool that then converts into motion of a selected downhole tool or tool component. These tools typically have a housing (or sleeve), and the power charge therein. Ignition of the power charge may occur from various means, such as transmission of electrical current from the surface to an ignitor disposed proximate to the power charge. Once ignited, the power charge burns, which results in creating of a pressurized gas.

The downhole tool actuation time is dependent on the power charge burn time. With a particular composition and geometry, conventional burn times range from 1-3 seconds for a standard set power charge to 30-60 seconds for a slow-set power charge. When activated, the power charge begins to burn on a first end with the flame propagating towards a second end. The speed of the burn depends on various factors, including the length of the power charge, power charge composition, and surrounding conditions.

Another problem with setting tools is the overall length of the setting tool, along with maintenance requirements. In order to alleviate damage from impact forces that can occur, setting tools may incorporate a liquid (usually oil) dampener. But to do so requires increasing the length of the setting tool. Without the liquid dampener the components of the setting tool would be susceptible to incurring significant forces upon disconnect of the setting tool from a respective downhole tool. The use of a liquid dampener also comes with additional maintenance requirements. Conventional setting tools also tend to utilize stronger (and therefore more expensive) materials in order to accommodate repetitive use, leading to high capital costs.

In other instances, service providers are often left trying to mate a setting tool made by one company with a downhole tool made by another company, with neither of these tools being made with each other specifically in mind. And while adapters exist, it is desirous to have a combination assembly configured with each of a setting tool (pre-mated) with a downhole tool, whereby the tools are able to cooperate with each other.

What is needed is a setting tool that facilitates a shorter setting tool that requires reduced, cheaper materials. There is a need for a setting tool that does not require refurbishment or re-use. What is needed is a setting tool that provides on or more synergized drivers for operators to move away from archaic setting tool technology.

SUMMARY

Embodiments of the disclosure pertain to a method of using a setting tool assembly to set a downhole tool in a wellbore that may include one or more steps of: running a workstring into the wellbore to a desired location; and activating an initiating event that results in setting the downhole tool.

The setting tool assembly and the downhole tool may be pre-assembled. The setting tool assembly and the downhole tool may be assembled as a combination downhole tool. The setting tool assembly may include any of: a head adapter that may be coupled with the workstring; a power charge mandrel that may be coupled with the head adapter. The power charge mandrel may have a power charge disposed therein; a barrel piston that may be coupled with the power charge mandrel; a tension mandrel that may be disposed, at least partially, within the barrel piston. There may be a pressure chamber accessible between the power charge mandrel and the tension mandrel;

The assembly may include a setting sleeve having a first setting sleeve end coupled with the barrel piston via one or more securing members, and a second setting sleeve end coupled with the downhole tool;

Setting of the downhole tool may include whereby the power charge burns to create an increase in fluid pressure within the pressure chamber sufficient to move the barrel piston. The barrel piston may include a barrel piston end having an inner diameter. The tension mandrel may include a tension mandrel end having an outer diameter. The outer diameter may be larger than the inner diameter.

In operation, the inner diameter (surface) of the barrel piston end may engage and bottom out on the outer diameter (surface) of the tension mandrel end upon a stroke of the setting tool assembly. The stroke may be driven by the fluid pressure generated by burning the power charge.

This maximum stroke of the setting tool may be defined by the bottoming out of the barrel piston.

The method may include the workstring having a lower end having a setting tool coupled with the downhole tool. The setting tool may include a head adapter coupled with the workstring.

Embodiments of the disclosure pertain to a method of using a setting tool assembly to set a downhole tool in a wellbore that may include one or more steps of: running a workstring into the wellbore to a desired location; and/or igniting a power charge disposed within a setting tool assembly to begin forming a gas.

The setting tool assembly may be coupled with the workstring, and may include any of the following: a power charge mandrel having an upper power mandrel end coupled with the workstring, and further having a lower mandrel; a sliding pressure chamber further comprising: an upper pressure chamber end releasably coupled with the upper power mandrel end, an inner chamber surface having a first shoulder proximate a second shoulder, and defining a working surface area therebetween; a setting sleeve having a first end coupled with the sliding pressure chamber, a second end coupled with a downhole tool; a tension mandrel coupled with the lower mandrel end, and having an outer tension mandrel surface slidingly engaged with another component.

The power charge may burn within a first burn range of 1 second to 120 seconds to create a first amount of pressure within the first movant chamber sufficient to cause release of the sliding pressure chamber from the power charge mandrel. Thereafter, the power charge may continue to burn for an intermediate burn range to create a second amount of pressure to cause an effective stroke of the setting tool assembly.

The method may include continuing to burn the power charge to create a next amount of pressure within the first movant chamber sufficient to disconnect the downhole tool from the setting tool assembly.

The effective stroke may include or result in setting the downhole tool. The effective stroke may include or result in disconnect of the setting tool assembly from the downhole tool. The effective stroke may include or result in setting of and disconnect from the downhole tool.

In aspects, the running step configuration of the setting tool assembly may include a first movant gas chamber. The first movant gas chamber may be in fluid communication with an inner charge bore of the power charge mandrel.

The power charge may continue to burn in a final burn range of up to 120 seconds to create the next amount of pressure in a pressure range between 7,500 psi to 10,000 psi within the first movant chamber.

A total stroke (or total stroke length) of the setting tool assembly may be equivalent to the sufficient effective stroke added to a dampening stroke. The total stroke length may be a distance of about 6 inches to 10 inches. The effective stroke may have a length in the range of about 4 inches to about 6.5 inches.

The setting tool assembly may be void of liquid oil dampener. The power charge may be cylindrical. The power charge may be non-linear. The power charge may have a charge mass of about 300 grams to about 400 grams. The power charge may be configured to burn in a total burn range of 20 seconds to 120 seconds. The power charge mandrel may have a plurality of ports to provide fluid communication between the inner bore and the first movant chamber.

These and other embodiments, features and advantages will be apparent in the following detailed description and drawings.

BRIEF DESCRIPTION OF THE DRAWINGS

For a more detailed description of the present disclosure, reference will now be made to the accompanying drawings, wherein.

DETAILED DESCRIPTION

Figure 1:
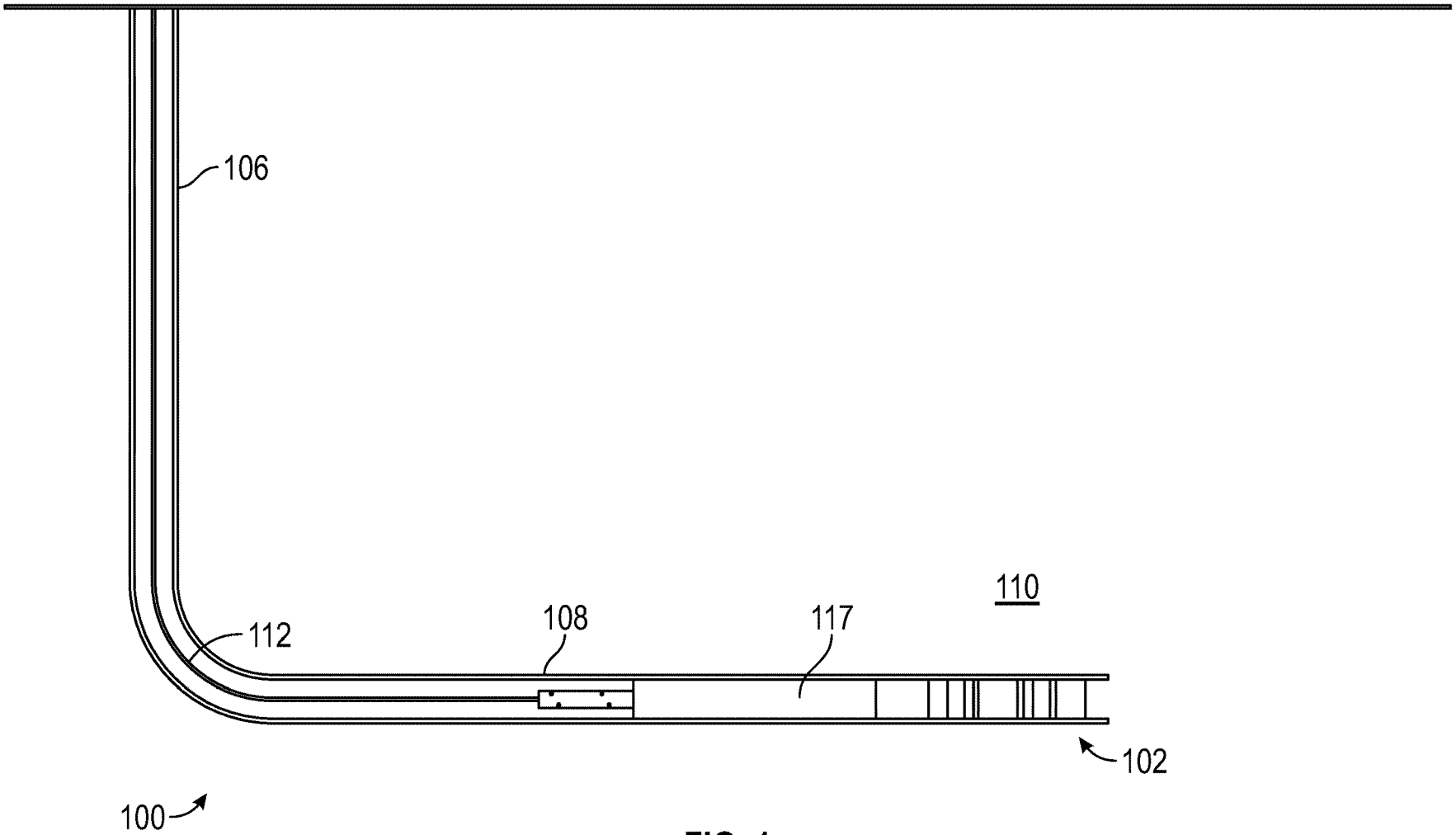
FIG. 1 (Prior Art)
FIG. 1 is a side view of a process diagram of a conventional plugging system.

Herein disclosed are novel apparatuses, systems, and methods that pertain to downhole tools usable for wellbore operations, and aspects (including components) related thereto, the details of which are described herein.

Embodiments of the present disclosure are described in detail with reference to the accompanying Figures. In the following discussion and in the claims, the terms "including" and "comprising" are used in an open-ended fashion, such as to mean, for example, "including, but not limited to . . . ". While the disclosure may be described with reference to relevant apparatuses, systems, and methods, it should be understood that the disclosure is not limited to the specific embodiments shown or described. Rather, one skilled in the art will appreciate that a variety of configurations may be implemented in accordance with embodiments herein.

Although not necessary, like elements in the various figures may be denoted by like reference numerals for consistency and ease of understanding. Numerous specific details are set forth in order to provide a more thorough understanding of the disclosure; however, it will be apparent to one of ordinary skill in the art that the embodiments disclosed herein may be practiced without these specific details. In other instances, well-known features have not been described in detail to avoid unnecessarily complicating the description. Directional terms, such as "above," "below," "upper," "lower," "front," "back," "right", "left", "down", etc., may be used for convenience and to refer to general direction and/or orientation, and are only intended for illustrative purposes only, and not to limit the disclosure.

Connection(s), couplings, or other forms of contact between parts, components, and so forth may include conventional items, such as lubricant, additional sealing materials, such as a gasket between flanges, PTFE between threads, and the like. The make and manufacture of any particular component, subcomponent, etc., may be as would be apparent to one of skill in the art, such as molding, forming, press extrusion, machining, or additive manufacturing. Embodiments of the disclosure provide for one or more components to be new, used, and/or retrofitted.

Numerical ranges in this disclosure may be approximate, and thus may include values outside of the range unless otherwise indicated. Numerical ranges include all values from and including the expressed lower and the upper values, in increments of smaller units. As an example, if a compositional, physical or other property, such as, for example, molecular weight, viscosity, melt index, etc., is from 100 to 1,000, it is intended that all individual values, such as 100, 101, 102, etc., and sub ranges, such as 100 to 144, 155 to 170, 197 to 200, etc., are expressly enumerated. It is intended that decimals or fractions thereof be included. For ranges containing values which are less than one or containing fractional numbers greater than one (e.g., 1.1, 1.5, etc.), smaller units may be considered to be 0.0001, 0.001, 0.01, 0.1, etc. as appropriate. These are only examples of what is specifically intended, and all possible combinations of numerical values between the lowest value and the highest value enumerated, are to be considered to be expressly stated in this disclosure.

Embodiments herein may be described at the macro level, especially from an ornamental or visual appearance. Thus, a dimension, such as length, may be described as having a certain numerical unit, albeit with or without attribution of a particular significant figure. One of skill in the art would appreciate that the dimension of "2 centimeters" may not be exactly 2 centimeters, and that at the micro-level may deviate. Similarly, reference to a "uniform" dimension, such as thickness, need not refer to completely, exactly uniform. Thus, a uniform or equal thickness of "1 millimeter" may have discernable variation at the micro-level within a certain tolerance (e.g., 0.001 millimeter) related to imprecision in measuring and fabrication.

Terms

The term "connected" as used herein may refer to a connection between a respective component (or subcomponent) and another component (or another subcomponent), which can be fixed, movable, direct, indirect, and analogous to engaged, coupled, disposed, etc., and can be by screw, nut/bolt, weld, and so forth. Any use of any form of the terms "connect", "engage", "couple", "attach", "mount", etc. or any other term describing an interaction between elements is not meant to limit the interaction to direct interaction between the elements and may also include indirect interaction between the elements described.

The term "fluid" as used herein may refer to a liquid, gas, slurry, multi-phase, etc. and is not limited to any particular type of fluid such as hydrocarbons.

The term "composition" or "composition of matter" as used herein may refer to one or more ingredients, components, constituents, etc. that make up a material (or material of construction). For example, a material may have a composition of matter. Similarly, a device may be made of a material having a composition of matter. The composition of matter may be derived from an initial composition. Composition may refer to a flow stream of one or more chemical components. A composition need not require a second or additional constituent elements, and thus may be a singular material. The singular material may include negligible or trace amounts of impurities.

The term "chemical" as used herein may analogously mean or be interchangeable to material, chemical material, ingredient, component, chemical component, element, substance, compound, chemical compound, molecule(s), constituent, and so forth and vice versa. Any 'chemical' discussed in the present disclosure need not refer to a 100% pure chemical. For example, although 'water' may be thought of as H2O, one of skill would appreciate various ions, salts, minerals, impurities, and other substances (including at the ppb level) may be present in 'water'. A chemical may include all isomeric forms and vice versa (for example, "hexane", includes all isomers of hexane individually or collectively).

For some embodiments, a material of construction may include a composition of matter designed or otherwise having the inherent characteristic to react or change integrity or other physical attribute when exposed to certain wellbore conditions, such as a change in time, temperature, water, heat, pressure, solution, combinations thereof, etc. Heat may be present due to the temperature increase attributed to the natural temperature gradient of the earth, and water may already be present in existing wellbore fluids. The change in integrity may occur in a predetermined time period, which may vary from several minutes to several weeks. In aspects, the time period may be about 12 to about 36 hours.

The term "fracing" or "frac operation" as used herein may refer to fractionation of a downhole well that has already been drilled. The same may also be referred to and interchangeable with the terms facing operation, fractionation, hydrofracturing, hydrofracking, fracking, hydraulic fracturing, frac, and so on. A frac operation may be land or water based.

The term "stroke" or "total stroke" as used herein may refer to a complete range of total movement of a sliding sleeve with respect to a starting position, typically in a magnitude of inches. The starting position may be analogous to a pre-stroke position, and the final position may be analogous to a post-stroke position or total stroke.

The term "effective stroke" as used herein may refer to the range of movement of a sliding sleeve or housing with respect to a starting position, to which a downhole tool may be set. Typically, the effective stroke may be in a magnitude of inches. The setting stroke may be an intermediate position within the range of or equal to the effective stroke. The amount of stroke required for setting and disconnect of the downhole too may be less than or equal to the effective stroke. The effective stroke may be the length of stroke immediately proceeding pressure equalization.

The term "dampening stroke" (also equalization stroke) as used herein may refer to the range of movement of a sliding sleeve or housing after the setting stroke, and after the effective stroke. The total stroke of the setting tool may equal the effective stroke plus the dampening stroke.

The term "axial" as used herein may refer to orientation of a feature with respect to an axis. For example, a port may be 'axial', meaning the port has a centerline parallel to a reference axis, such as a longitudinal tool axis, within a high degree of precision and tolerance (e.g., 0.1 degrees).

Any component described herein may be made of a metallic material, alloy, and so forth. Any component described herein may be made of a composite or plastic material, such as filament wound composite. Any component described herein may be made of a reactive material, which may be metallic, composite, or as otherwise desired. Any component may be made from a machining process, such as CNC machining, laser cutting, 3D printing (or additive manufacturing), and the like.

Figure 2A:
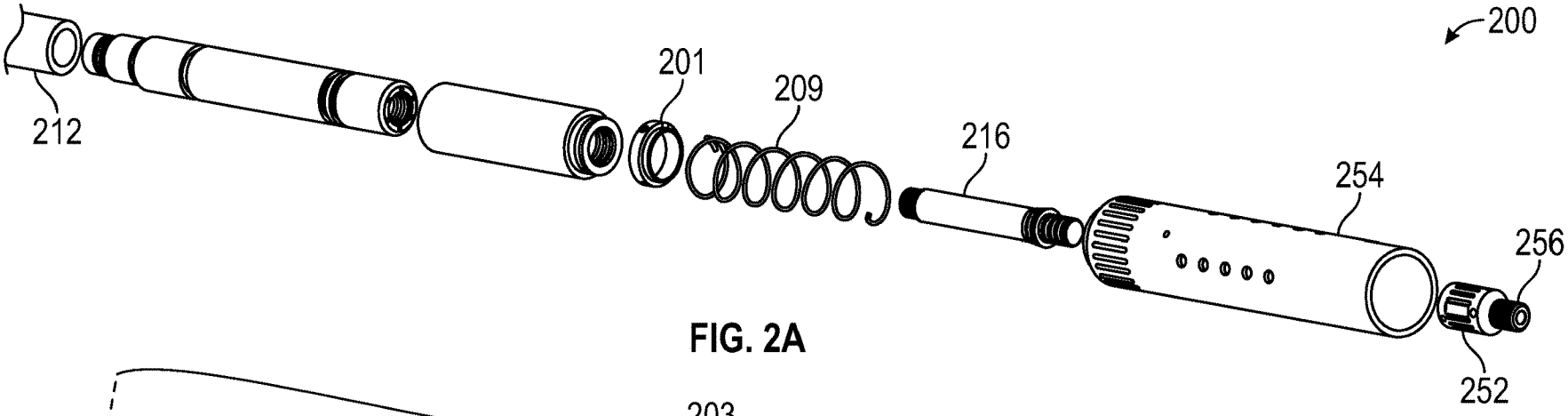
FIG. 2A shows an isometric component breakout view of a system having a downhole tool, according to embodiments of the disclosure.
Figure 2B:
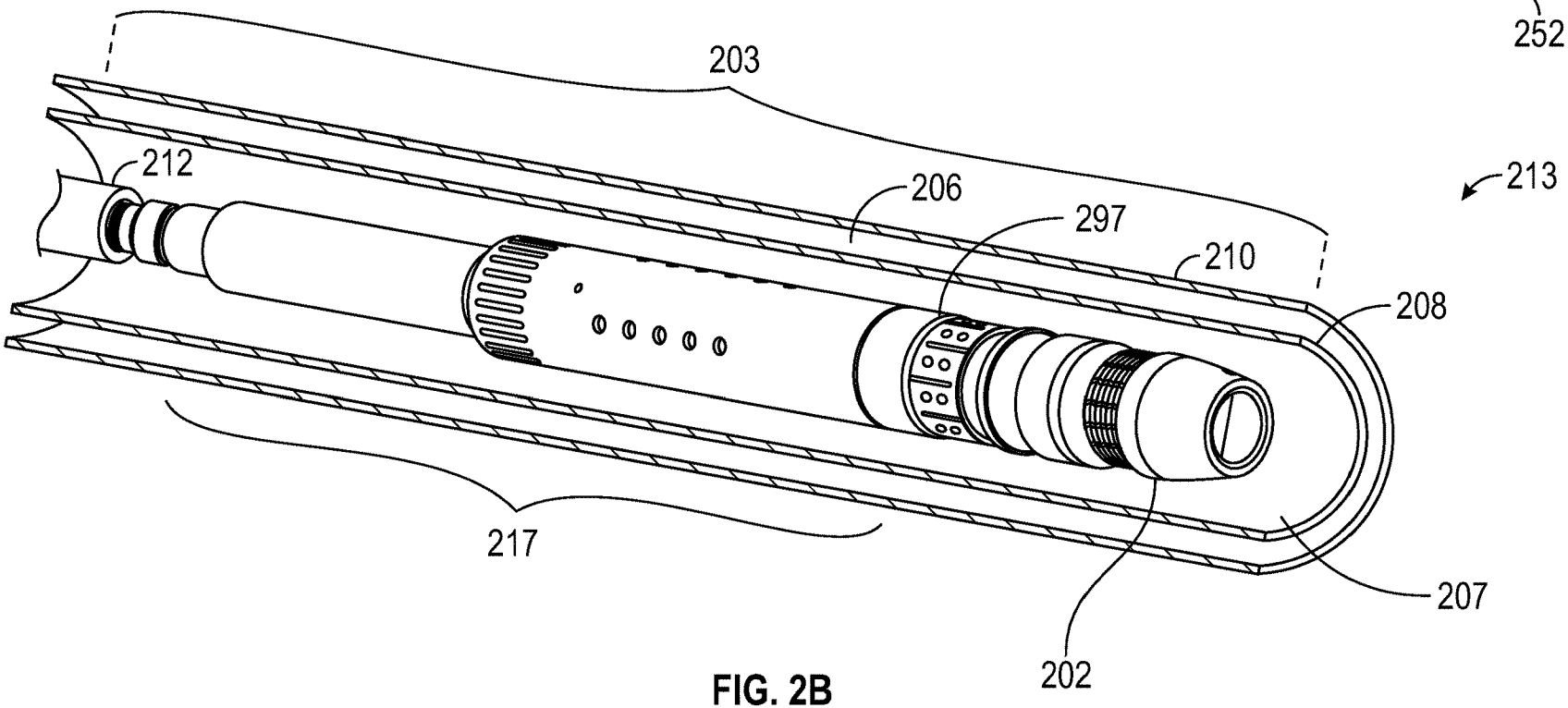
FIG. 2B shows an isometric view of a system having a combination setting tool and downhole tool assembly run in a wellbore, according to embodiments of the disclosure.

Referring now to FIGS. 2A and 2B together, isometric views of a system 200 having a downhole tool 202 illustrative of embodiments disclosed herein, are shown. FIG. 2B depicts a wellbore 206 formed in a subterranean formation 210 with a tubular 208 disposed therein. In an embodiment, the tubular 208 may be casing (e.g., casing, hung casing, casing string, etc.) (which may be cemented). A workstring 212 (shown only in part here; and which may include a setting tool 217 having an adapter 252—which may have threads 256) may be used to position or run the downhole tool 202 into and through the wellbore 206 to a desired location. The setting tool 217 and the downhole tool 202 may be coupled together to form a combination downhole assembly 203.

In accordance with embodiments of the disclosure, the tool 202 may be configured as a plugging tool, which may be set within the tubular 208 in such a manner that the tool 202 forms a fluid-tight seal against the inner surface 207 of the tubular 208. In an embodiment, the downhole tool 202 may be configured as a bridge plug, whereby flow from one section 213 of the wellbore to another (e.g., above and below the tool 202) is controlled. In other embodiments, the downhole tool 202 may be configured as a frac plug, where flow into one section 213 of the wellbore 206 may be blocked and otherwise diverted into the surrounding formation or reservoir 210.

In yet other embodiments, the downhole tool 202 may also be configured as a ball drop tool. In this aspect, a ball may be dropped into the wellbore 206 and flowed into the tool 202 and come to rest in a corresponding ball seat at the end of a mandrel. The seating of the ball may provide a seal within the tool 202 resulting in a plugged condition, whereby a pressure differential across the tool 202 may result. The ball seat may include a radius or curvature.

In other embodiments, the downhole tool 202 may be a ball check plug, whereby the tool 202 is configured with a ball already in place when the tool 202 runs into the wellbore. The tool 202 may then act as a check valve, and provide one-way flow capability. Fluid may be directed from the wellbore 206 to the formation with any of these configurations. Once the tool 202 reaches the set position within the tubular, the setting mechanism or workstring 212 may be detached from the tool 202 by various methods, resulting in the tool 202 left in the surrounding tubular and one or more sections of the wellbore isolated.

The tool 202 may include an anti-rotation assembly that includes an anti-rotation device or mechanism 209, which may be a spring, a mechanically spring-energized composite tubular member, and so forth. The device 209 may be configured and usable for the prevention of undesired or inadvertent movement or unwinding of the tool 202 components. As shown, the device 209 may reside in within the sleeve (or housing) 254. During assembly the device 209 may be held in place with the use of a lock ring or cap 201. In other aspects, pins may be used to hold the device 209 in place.

In accordance with the disclosure, the setting tool 217 may be activated via a signal. The signal may be, for example, via electric transmission from a surface facility (operator workstation, etc.) through the workstring 212 down tool the setting tool 217.

Upon activation, a trigger mechanism such as a firing head (not shown here) may activate in such a manner that a power charge or other material is ignited and begins to burn. The combustion gases increase fluid pressure within the setting tool 217, which may act on one or more working surfaces consequently begins to move (or urge) one or more housings or sleeves against the downhole tool 202. For example, a setting sleeve 254 may be urged against a bearing plate or sleeve 297 (or other component surface of the tool 202).

In an embodiment, once the tool 202 is set, tension may be applied to the adapter 252 (such as via tension mandrel 216) until the threaded connection between the adapter 252 and the mandrel (or other component of the tool 202) is broken. For example, the mating threads (256) on the adapter 252 and/or the mandrel may be designed to shear, and thus may be pulled and sheared accordingly in a manner known in the art. The amount of load applied to the adapter 252 may be in the range of about, for example, 20,000 to 55,000 pounds force. The amount of load is not meant to be limited, as the combination assembly 203 of the disclosure may include varied setting and downhole tools suitable to different environments. It would be apparent that the setting force requirement is less than the disconnect force requirement.

Accordingly, the adapter 252 may separate or detach from the mandrel (e.g., 314, FIG. 3B) (or other component of the tool 202), resulting in the workstring 212 being able to separate from the tool 202, which may be at a predetermined moment. The loads provided herein are non-limiting and are merely exemplary. The setting force may be determined by specifically designing the interacting surfaces of the tool, surface area, the respective tool surface angles, etc.

Figure 3A:
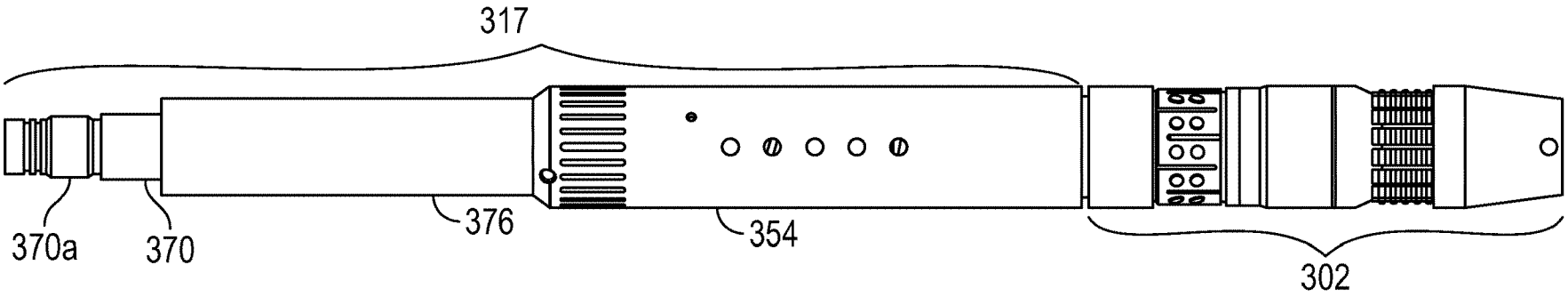
FIG. 3A shows a longitudinal side view of a combination setting tool and downhole tool assembly prior to setting of a downhole tool according to embodiments of the disclosure.
Figure 3B:
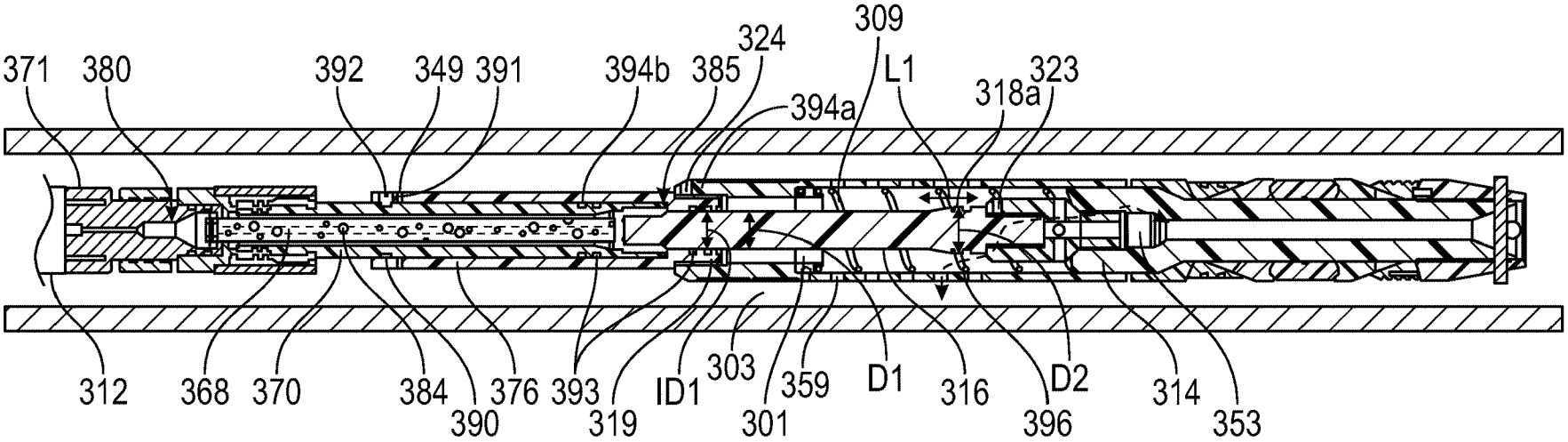
FIG. 3B shows a longitudinal side cross-sectional view of the setting tool connected with the downhole tool and in a run-in position according to embodiments of the disclosure.

Referring now to FIGS. 3A, 3B, 3C, and 3D together, a longitudinal side view of a combination setting tool and downhole tool assembly prior to setting of a downhole tool, a longitudinal side cross-sectional view of the assembly of FIG. 3A having the setting tool connected with the downhole tool in a run-in position, a longitudinal side cross-sectional view, and a partial a close-up side cross-sectional view, of the setting tool assembly after disconnect from the downhole tool, respectively, according to embodiments disclosed herein, are shown.

Although referenced as a setting tool, the setting tool 317 may be understood to be an assembly, and thus an assembly of various (sub)components, namely, one or more outer housings, inner housings, mandrels, pistons, sealing member (e.g., o-rings), and so forth. 'Setting tool' and 'setting tool assembly' are meant to have the same meaning. One or more members may be slidingly movable with respect to others. As evident here, the setting tool 317 may be void of an oil chamber.

The setting tool 317 may be coupled with a downhole tool 302, such as a frac plug or the like. Embodiments herein pertain to a combination setting tool and downhole tool assembly that may together be provided directly to a user (whereas each of a setting tool and the downhole tool are typically provided independent of each other). The coupling of the tools 302, 317 may be referred to together herein as the combination [downhole] assembly 303.

For brevity and simplicity, components uphole or downhole of the assembly 317 may be shown in part, or not at all. However, one of skill would appreciate their presence in an operational sense, even if not depicted in the Figures in totality or at all.

The Figures together show the combination assembly 303 may include a head adapter 371 coupled with a first or upper housing 370, referenced hereinafter as a power charge mandrel. The head adapter 371 may be readily adaptable to connect with varied connection points of a workstring 312 (shown only in part here). Thus, the head adapter (housing) 371 may be contemplated as just being an 'adapter housing'. The setting tool 317 may include the power charge mandrel 370 coupled with a first (pressure) stage housing 376, which may also be referred to as a barrel piston.

Of interest, the barrel piston 376 need not require any kind of retainer sleeve to be coupled therewith and to the power charge mandrel 370. As shown here, the assembly 303 may be void of a retainer sleeve (or ring, cap, etc.) (in contrast to presence and need of retainer ring 20 in U.S. Pat. No. 9,810,035 and/or cap 39 in U.S. Patent Publication No. 2020/0115978). Operation of the setting tool 317 without a retainer ring is aided by the presence of a deceleration or dampening configuration described herein.

Either or both of the power charge mandrel 370 and the barrel piston 376 may be coupled in some fashion with a tension mandrel 316. For flexibility and convenience, the setting tool assembly 317 may include a setting sleeve adapter (not shown here), whereby the assembly 317 may be readily coupled with any number of setting sleeves and/or tool adapters. The setting sleeve adapter may be associated with operable systems, subsystems, assemblies, modules, skids, and so forth, including those described herein. The setting sleeve adapter may be of any suitable shape, such as generally cylindrical or comparable.

The barrel piston 376 may be movingly (such as slidingly, sealingly) engaged with a tension mandrel 316. The barrel piston 376 may be securingly engaged with the power charge mandrel 370 in the pre-set configuration, i.e. before activation. However, the barrel piston 376 may also be movingly (releasably) engaged with the power charge mandrel 370 once a setting sequence begins, i.e. after activation has been initiated. For example, in a first (or assembled, run-in, etc.) position the barrel piston 376 may be engaged to the power charge mandrel 370 via one or more shear screws 392 (or other comparable mechanism) (see FIG. 3B). The shear screw(s) 392 or other retainer mechanism may be screwed through piston screw bore 391 and into recess region(s) 390.

Figure 3C:
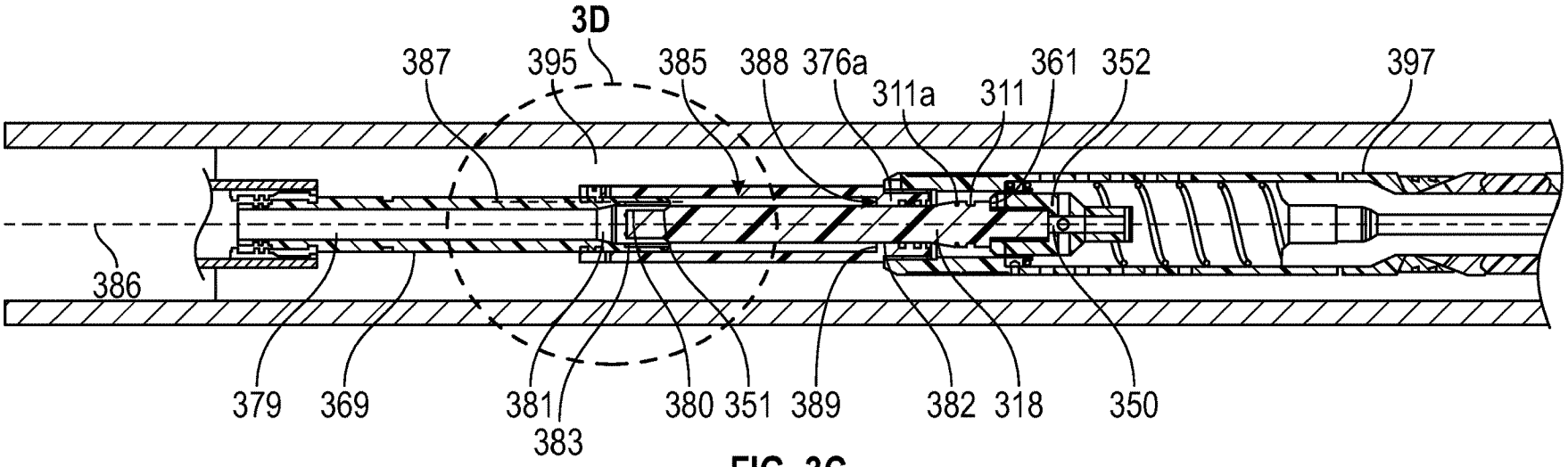
FIG. 3C shows a longitudinal side cross-sectional view of the setting tool assembly after disconnect from the downhole tool according to embodiments of the disclosure.
Figure 3D:
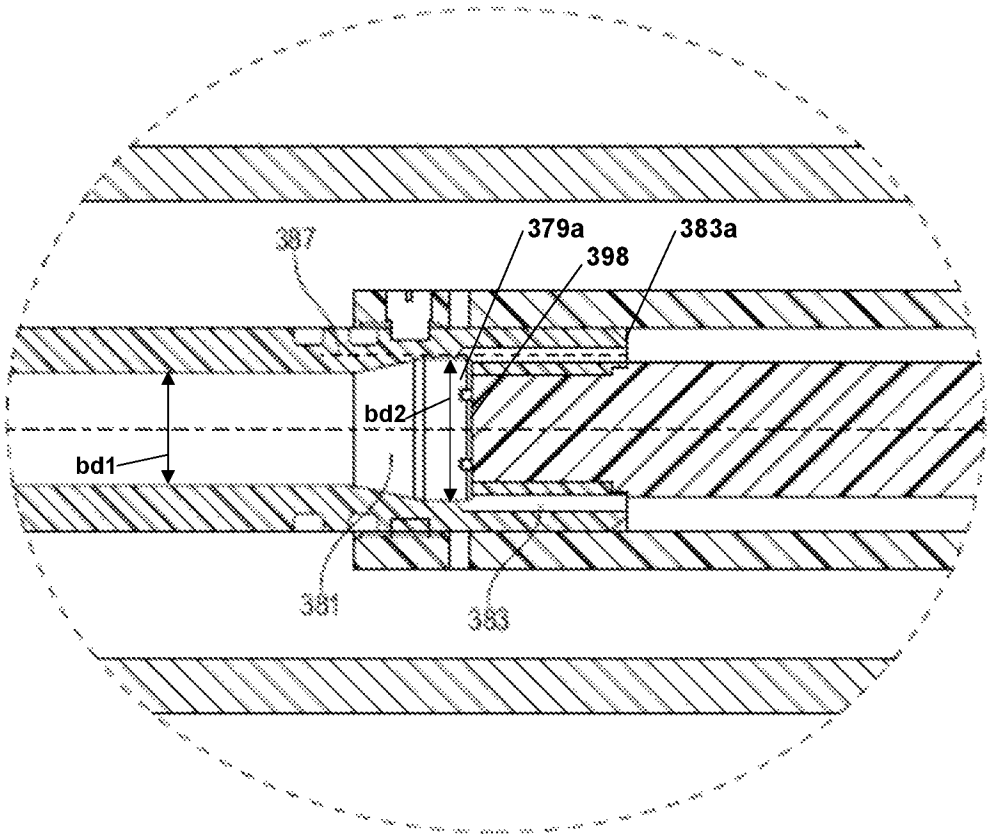
FIG. 3D shows a close-up side cross-sectional view of part of the setting tool assembly of FIG. 3C according to embodiments of the disclosure.
Figure 4A:
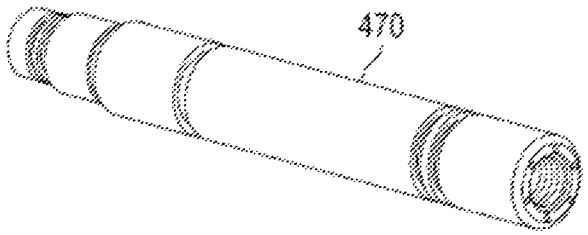
FIG. 4A shows an isometric view of a power charge mandrel according to embodiments of the disclosure.
Figure 4B:
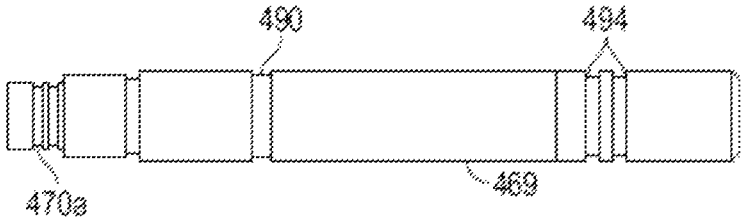
FIG. 4B shows a longitudinal side view of the power charge mandrel of FIG. 4A according to embodiments of the disclosure.
Figure 4C:
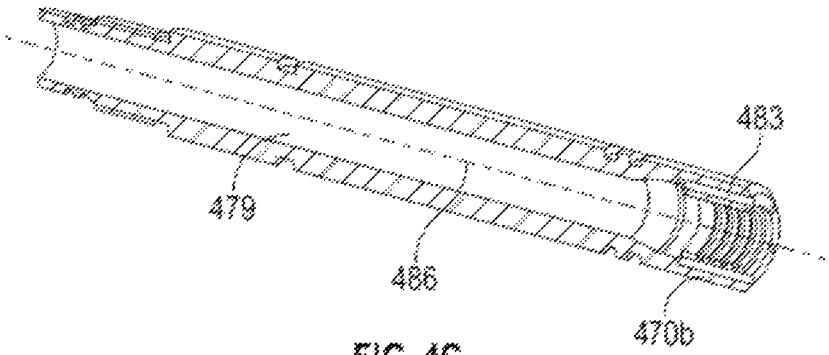
FIG. 4C shows an isometric cross-sectional view of the power charge mandrel of FIG. 4A according to embodiments of the disclosure.
Figure 4D:
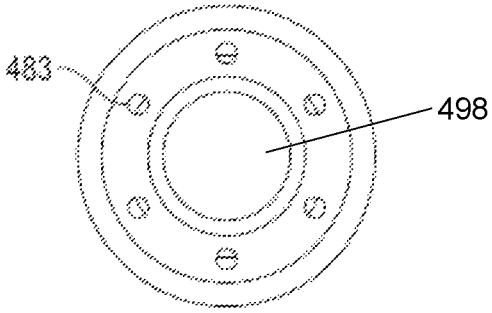
FIG. 4D shows a lateral downhole end view of the power charge mandrel of FIG. 4A according to embodiments of the disclosure.

Once the assembly 303 reaches a desired location, and after breaking/shearing the screw 392, in a second (or setting, etc.) position, the piston 376 may slidingly move along the mandrel 370 (see FIG. 3C).

The power charge mandrel 370 may be securingly engaged with the tension mandrel 316, such as threadingly engaged (see threaded connection 351). The barrel piston 376 may be configured for secured attachment to another member (such as threads, pins, and the like), such as with the setting sleeve 354 (which may engage or abut against the downhole tool 302). Threads include stub acme, buttress, and the like. 'Pins' may include a set screw(s), drive pins, or other comparable securing device. To be clear, the barrel piston 376 may be coupled with the setting sleeve 354 in a manner that does not require nor utilize threads, threaded connection, mating threads, etc.

Of significance, the setting sleeve 354 may be made of a composite material, such as filament wound material. Conventional setting sleeves are steel because they are generally used multiple times and need to be durable. Of course, metallic material may be used for the setting sleeve 354.

It has been discovered with unexpected results that use of composite material for the setting sleeve 354 may provide the benefits of lower cost and reduced weight while providing adequate strength.

To aid sealing engagement, there may be one or more O-rings 393 disposed between proximate surfaces, such as within O-ring recess(es) 394 *a,b*, as would be apparent to one of skill in the art.

The power charge mandrel 370 may be an elongated cylindrical-type member, albeit with varied OD and/or ID in portions thereof. There may be an upper end 370*a* of the mandrel 370 configured for attachment with the head housing 371. The head housing 371 may be configured for coupling the assembly 317 with part of a workstring (or a component thereof) 312. Although illustrated here as an external mate, the coupling could just as well be reversed (internal mate).

The upper end 370*a* may be configured for attaching to the head housing 371, such as via a threaded connection or the like. Thus, each of the power charge mandrel 370 and the head housing 371 may have respective threads configured for mating. Threads may include stub acme, buttress, and the like. The connection may also be pinned, screwed, set screw, etc. One of skill would appreciate that other (sub)components of the combination assembly 303 may be coupled in a similar manner, even if not shown or described in detail here.

The power charge mandrel 370 may have an inner charge bore 379 for which a power charge 368 may be disposed therein. The firing head 371 may have a corresponding firing head bore 380 that may provide a flame path for a respective flame or other igniting source to communicate to the inner charge bore 379 (and ultimately to the charge 368). The inner charge bore 379 may have an inner transition region 381, whereby the bore 379 has a first inner bore diameter bd1 that enlarges at a lower bore end 379*a* to a second inner bore diameter bd2. As such, the second inner bore diameter bd2 may be larger than the inner bore diameter bd1.

As the power charge 368 need not be rigid or solid (and thus may be soft or putty- or paste-like), the power charge 368 may assume the general shape of the inner charge bore 379 (or a charge housing—not shown here). Various other shapes are possible, such as cylindrical, rectangular prism, helical (coiled), cylindrical-helical, and the like. As shown here, neither the power charge 368, nor the inner charge bore 379 (or its lower end 379*a*), need extend past blind end 398. It follows that neither the power charge 368, nor the inner charge bore 379, need extend past a lower portion 383*a* of port(s) 383.

The power charge 368 may be of a sufficient amount to have burn time of about 5 seconds to about 120 seconds. The amount of power charge 368 may be about 150 grams to about 450 grams by weight. The amount of power charge may be of sufficient amount to provide enough gas via reaction to provide at least 8,500 psi within a primary gas chamber 385. The amount of pressure within the primary gas chamber upon burning of the power charge 368 may be about 7,500 psi to about 25,000 psi.

Actuation of the power charge 368 may be from or via a signal from the surface (e.g., surface facility, an operator, etc.), which may then instigate igniters installed in the firing head 371 to fire an initiator pellet, which may then start the propellant reaction of the power charge 368 (or other suitable firing mechanism). Pressure may be generated within the inner charge bore 379 by the propellant reaction as a result of forming gas. The gas 384 formed initially within the bore 379 may be fluidly communicated to the primary chamber 385 via one or more ports 383. In embodiments, there may be about 1 to about 15 ports 383. The ports 383 may be spaced symmetrically, asymmetrically, or combinations of both, with respect to each other. The ports 383 may be axial. In this respect, the ports 383 may have a longitudinal bore axis 387 in parallel to a longitudinal tool axis 386.

As the gas 384 increases, expands, and moves into the primary chamber 385, it may act on a pressure chamber piston area, or working area, 388. The annular surface from about the first shoulder 389 to the second shoulder 382 may be the (approximate) working surface to which the pressure (and thus force) is applied. Although not limited to any particular shape or size, the working movable surface 388 may have a surface area in a range of about 4 square inches to about 7 square inches. In embodiments, the surface area may be about 5 square inches.

Ultimately the pressure within the chamber 385 may increase to a first preliminary or pre-determined (or also first actuation) force that frees (or disengages) the barrel piston 376 from the power charge mandrel 370. This first pre-determined force may be in the range of about 3,000 to about 6,500 lbs force. The first pre-determined force may be tantamount to an amount of pressure within the chamber 385 times the working surface area between the shoulders 382, 389, which may be in a range of about 800 psi to about 1300 psi. In embodiments, the pressure to provide the first pre-determined force may be about 1200 psi.

It may be desirous to have the first pre-determined force be about 4,000 lbs or greater in order to protect against inadvertent separation of the barrel piston 376 during run-in. On the other hand, too high of an activation force may result in reduced time to properly set the downhole tool 302, such that less than 6,500 lbs may suffice.

Once the first pre-determined force is exceeded, the shear screws 392 may shear, and the barrel piston 376 may now be free to slide. Continuing of the increase in pressure within the chamber 385 ultimately results in the setting sleeve 354 being urged more and more against the downhole tool 302 (as described herein, such as including against a bearing sleeve 397). The tool 302 may be like that as described and embodied within U.S. Pat. No. 8,997,853, incorporated herein in its entirety for all purposes, including as it pertains to a frac plug (and all of its components) and setting thereof.

The power charge mandrel 370 may have an outer surface 369, which may be suitable for the barrel piston 376 to slidingly engage therewith. Thus, the barrel piston 376 may be of a shape suitable to (movingly) cooperate with the power charge mandrel 370, such as cylindrical.

The power charge mandrel 370 may have a vent 349 configured to provide a flowpath from within the assembly 303 to the external side (such as to a surrounding annulus 395). The vent 349 may initially be closed or plugged, such as in the first position.

At run-in, the setting tool 317 may be at its pre-set or beginning (or first) position. During setting, the housing(s) may move a first distance equivalent to an effective stroke length. After setting, the tool 317 may be disconnected from the downhole tool 302 resulting in total stroke. In embodiments, the setting or disconnect sequence may be dramatic and/or instantaneous to the point that dampening may be provided between the components, thus alleviating or mitigating impact forces therebetween. This may be especially beneficial at the point where the setting tool 317 is disconnected from the downhole tool 302, and resistance against impact is reduced.

A lower end 376*a* of the barrel piston 376 that may engage the tension mandrel 316 may have an a lower end annulus having an inner diameter ID1. The inner diameter ID1 may be (substantially) equivalent to an outer diameter D1 of the tension mandrel 316 at a first end. The tension mandrel 316 may have a generally uniform outer diameter D1 for most of its longitudinal length, particularly in the area proximate to the lower end 376*a*. As such, for most of the setting sequence the barrel piston 376 may be movingly (albeit sealingly) engaged with the tension mandrel 316 without any significant resistance.

However, the lower end 376*a* may begin to engage a lower end 318 of the tension mandrel 316. The lower end 318 may have a flared or belled end 318*a*. The flared end 318*a* may have an outer diameter D2 that may be larger than the outer diameter D1. In embodiments, the outer diameter D2 progressively increases for a length L1 of the flared end 318*a*. As the diameter D2 may be larger than D1, and thus also larger than ID1, the lower end 376*a* may now experience resistance (i.e., dampening) in the event the setting sequence continue to urge it further. Tension mandrel may also have two or more discrete diameters increasing in stepwise fashion, e.g. D1, D2, . . . Dn, each Dn greater than the previous one.

The flared end 318*a* may end at a point where a shoulder 361 is thereby formed. The shoulder 361 may abut the adapter 352. The flared end 318*a* may include one or more grooves 311, 311*a*. The grooves 311, 311*a* may be lateral and annular in nature around a flared end outer surface. The use of grooves 311 and/or 311*a* may aid in predicting or controlling the deceleration effect against the barrel piston 376.

In aspects, there may in addition or in the alternative be a flared portion in the end of the barrel piston, or both the barrel piston and the tension mandrel, as alternative embodiments.

The lower end 376*a* may have an annular recess 319. The presence of the recess 319 may provide for space for metal to deform when absorbing remaining energy after disconnect action is complete. In the same vein, the groove(s) 311/311*a* may allow for deformation of the tension mandrel end during the stroke (or bottoming out of the barrel piston 376).

A second predetermined point may be completion of the setting sequence of the downhole tool. The downhole may be set in a setting force range of about 10,000 lbf to about 40,000 lbf. A third predetermined point may be completion of disconnect. The disconnect of the setting tool assembly from the downhole tool may occur with a force in the range of about 20,000 lbf to about 55,000 lbf. As would be apparent, the setting force should be less than the disconnect force for any given combination tool. One of skill would thus appreciate setting occurs before disconnect.

In aspects, prior to the barrel piston 376 bottoming out of the end of the tension mandrel 316, the outer ports 349 in the barrel piston may be exposed to the gas chamber, which allows the remaining gas pressure to be relieved into the well. This may facilitate alleviating bringing the setting tool back to surface with pressurized gas (which can otherwise be a major safety issue).

To alleviate potential pressure buildup from or against the downhole tool 302, there may be a relief flow path (shown by path line 353). As shown in part, the relief flow path may be through one or more of an adapter bore 350, to a side or radial port 323, to an inner (tool) annulus 396, through one or more setting sleeve ports 359, and into an outer surrounding annulus 395. This may provide the combination assembly 303 with the ability to equalize pressure, such as when there might be a seated ball (not shown here).

The tool 302 may include an anti-rotation assembly that includes an anti-rotation device or mechanism 309, which may be a spring, a mechanically spring-energized composite tubular member, and so forth. The device 309 may be configured and usable for the prevention of undesired or inadvertent movement or unwinding of the tool 302 components. As shown, the device 309 may reside within the sleeve 354. During assembly the device 309 may be held in place with the use of a lock ring or cap 301. In other aspects, pins may be used to hold the device 309 in place.

The lock ring 301 may be disposed around a part of or associated with the setting tool 317. The lock ring 301 may be securely held in place with screws inserted through the sleeve 354. The lock ring 301 may include a guide hole or groove (not viewable here), whereby an end of the device 309 may slidingly engage therewith. Protrusions or dogs may be configured such that during assembly, the mandrel 314 and respective tool components may ratchet and rotate in one direction against the device 309; however, the engagement of the protrusions with the device 309 may prevent back-up or loosening in the opposite direction.

The anti-rotation mechanism may provide additional safety for the tool and operators in the sense it may help prevent inoperability of tool in situations where the tool is inadvertently used in the wrong application. For example, if the tool is used in the wrong temperature application, components of the tool may be prone to melt, whereby the device 309 and lock ring 301 may aid in keeping the rest of the tool together. As such, the device 309 may prevent tool components from loosening and/or unscrewing, as well as prevent tool 302 unscrewing or falling off the workstring 312.

Referring now to FIGS. 4A, 4B, 4C, and 4D together, an isometric view, a longitudinal view, an isometric cross-sectional view, and a later lower end view, respectively, of a power charge mandrel usable with a setting tool assembly in accordance with embodiments disclosed herein, are shown.

Embodiments herein apply to an upper housing associated with operable systems, subsystems, assemblies, modules, skids, and so forth, including those described herein. The upper housing may be referred to as a power charge mandrel that may be part of an overall setting tool assembly (see 317, FIG. 3A). While it need not be exactly the same, the power charge mandrel 470 may include various features and components like that of charge mandrel 370, and thus components thereof may be duplicate or analogous.

The power charge mandrel 470 may be a durable member of any suitable shape, such as generally cylindrical or comparable. The power charge mandrel 470 may be made of any material known for durability in wellbore operations, such as cast iron or steel. The housing may have an upper housing end 470*a* configured for coupling with an adapter housing (not shown here) as described herein, such as threaded. The upper end 470*a* may be adaptable to attach with a portion of a workstring (such as a firing head—not shown here). Although the end 470*a* is shown as to accommodate external connection thereto, could be vice versa.

The power charge mandrel 470 may have an inner charge bore 479, which may be configured to be used for one or more components to be disposed therein. For example, there may be a power charge (not shown here) disposed therein. The bore 479 may extend longitudinally through the entire body of the mandrel 470. In embodiments, either the upper end 470*a* or the lower end 470*b* of the power charge mandrel 470 may be configured with a blind end 498.

The size of the inner charge bore 479 (and surrounding wall thickness) may be suitable to facilitate and withstand the reactive burning (and thus creation of pressurized gas) of the power charge. The bore 479 may have a main diameter of about 0.5 inches to about 2 inches. The bore 479 may transition to a larger bore of increased diameter (see inner transition 381, FIG. 3C). The inner charge bore 479 may accommodate a volume of power charge suitable to provide a burn time range of about 10 seconds to about 120 seconds.

The power charge mandrel 470 may be configured for coupling (such as threadingly) to another component, such as with a head adapter, setting sleeve adapter, or another housing, including as described herein. In addition to threads, one or more set screws or other retainer mechanism may be screwed into recess region(s) 490. Initial coupling with the power charge mandrel 470 may be via a set or shear screw (or other suitable hold mechanism) by using annular screw recess 490.

To aid sealing engagement, there may be one or more O-rings disposed between proximate surfaces, such as within O-ring recess(es) 494, as would be apparent to one of skill in the art. To facilitate fluid communication (via flow-path), there may be one or more fluid ports, such as ports 483. One of skill would appreciate there may be a plurality of ports 483. One or more ports 483 may be axially aligned with a longitudinal axis 486. The ports 483 may be formed in a lower end 470*b* of the power charge mandrel 470.

The power charge mandrel 470 may have an outer surface 469, which may be suitable for another component (such as barrel piston 376) to slidingly engage therewith.

Figure 5A:
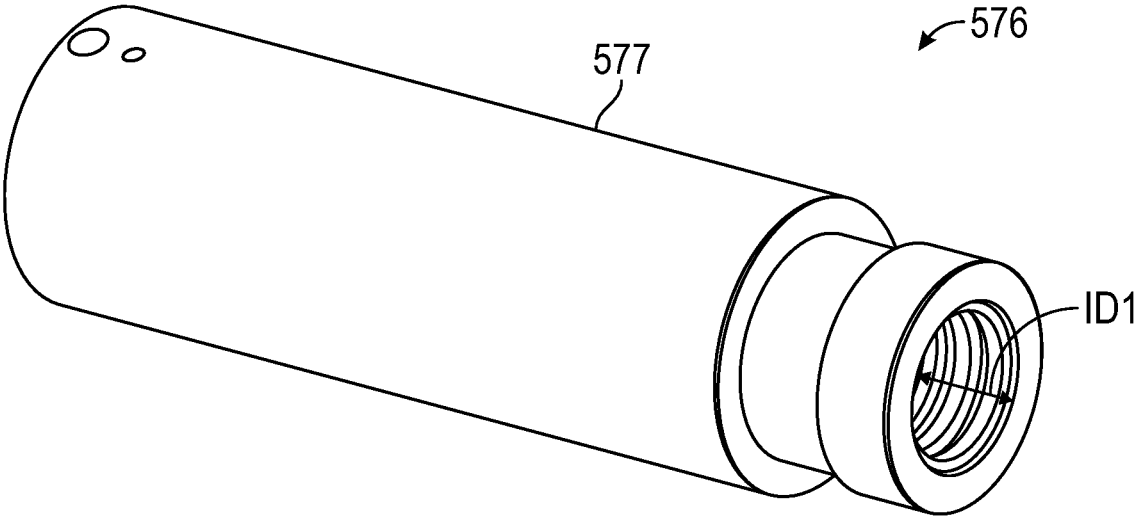
FIG. 5A shows an isometric view of a barrel piston according to embodiments of the disclosure.
Figure 5B:
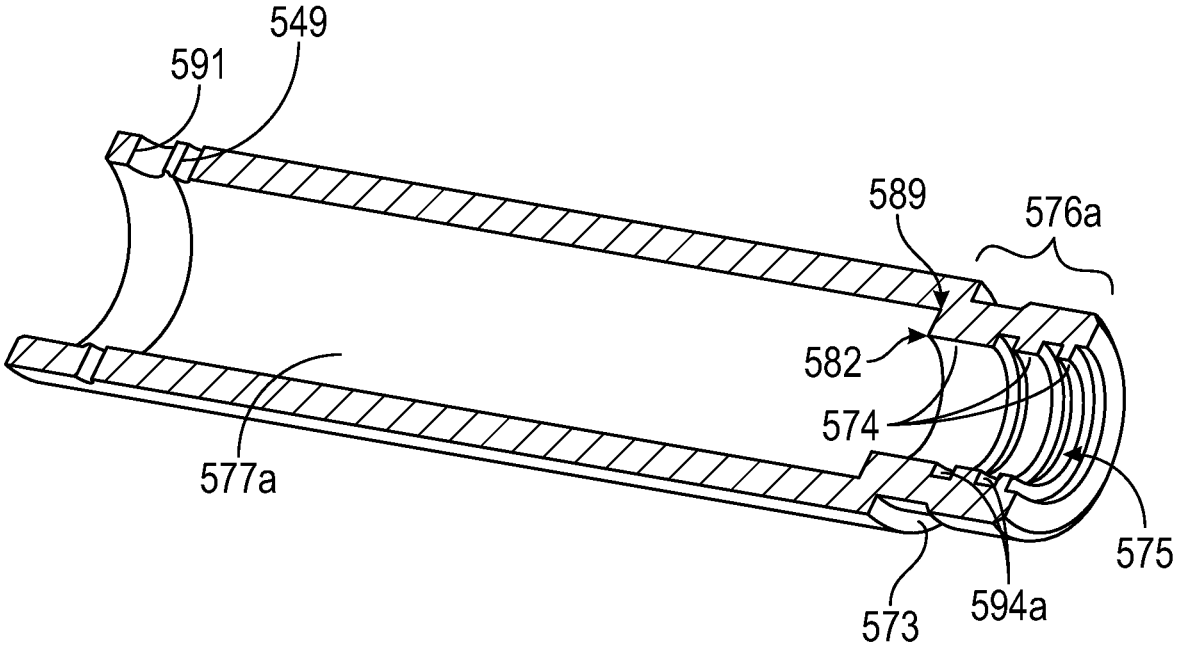
FIG. 5B shows an isometric cross-sectional view of the barrel piston of FIG. 5A according to embodiments of the disclosure.

Referring now to FIGS. 5A and 5B together, an isometric side view and an isometric cross-sectional view, respectively, of a barrel piston usable with a setting tool assembly in accordance with embodiments disclosed herein, are shown.

Embodiments herein apply to a sliding pressure chamber sub associated with operable systems, subsystems, assemblies, modules, skids, and so forth, including those described herein. The sliding pressure chamber may be referred to as a housing or a barrel piston. The barrel piston 576 may be part of an overall setting tool assembly, such as an assembly described herein (e.g., 317, FIG. 3A). While it need not be exactly the same, the barrel piston 576 may include various features and components like that of piston 576, and thus components thereof may be duplicate or analogous.

The barrel piston 576 may be a sliding sleeve-type member of any suitable shape, such as generally cylindrical or comparable. The barrel piston 576 may be made of any material known for durability in wellbore operations, such as cast iron or steel. The barrel piston 576 may have an upper end configured for coupling with a power charge mandrel (not shown here). The coupling may typically be insertion of one or more shear screws through respective screw bores 591.

The barrel piston 576 may have an inner piston bore 575 (of having an inner bore diameter ID1) for which an inner surface(s) 574 thereof may be configured for sliding engagement with an outer surface of the power charge mandrel (not shown here). The size of bore 562 may thus be sized to accommodate the OD of the power charge mandrel. The barrel piston 576 may thus have a lower end 576*a* configured with at least some degree of enclosure as compared to the rest of the piston 576. As shown here, an outer surface 577 of the piston 576 may be discontinuous at the end 576*a*. In an analogous manner, an inner surface 577*a* may be discontinuous at the end 576*a*, thereby resulting in the degree of enclosure.

The piston 576 may be configured for attaching to another threaded member via threads, such as with a setting sleeve adapter (e.g., 374, FIG. 3A). Threads include stub acme, buttress, and the like. In addition or in the alternative to threads, one or more securing members or other retainer mechanism may be inserted into a recess region(s) 573. To aid sealing engagement, there may be one or more O-rings disposed between proximate surfaces, such as within O-ring recess(es) 594*a*, as would be apparent to one of skill in the art.

The barrel piston 576 may have a first annular shoulder 589, and a second annular shoulder 582, which may be tantamount to a working surface area (e.g., 388, FIG. 3B) to which a movant pressure force may act on when gas is created from burning of a power charge.

The barrel piston 576 may have a vent or bleed 549, which may be a lateral hole through a sidewall of the piston 576.

Figure 6A:
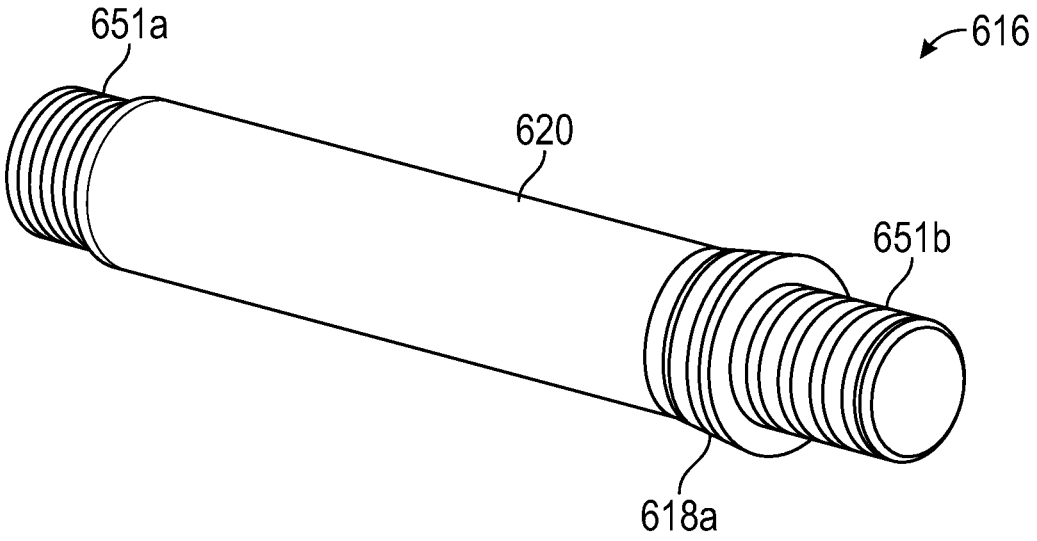
FIG. 6A shows an isometric view of a tension mandrel according to embodiments of the disclosure.
Figure 6B:
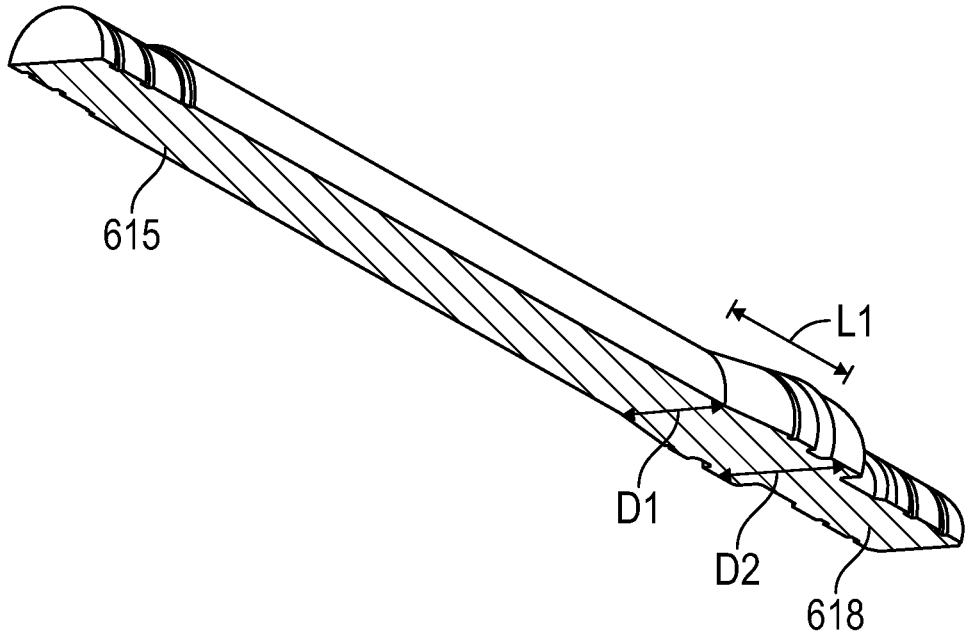
FIG. 6B shows an isometric cross-sectional view of the tension mandrel of FIG. 6A according to embodiments of the disclosure.

Referring now to FIGS. 6A and 6B together, an isometric view and an isometric cross-sectional view, respectively, of a tension mandrel usable with a setting tool assembly in accordance with embodiments disclosed herein, are shown.

Embodiments herein apply to a tension mandrel associated with operable systems, subsystems, assemblies, modules, skids, and so forth, including those described herein. The tension mandrel 616 may be part of an overall setting tool assembly, such as any assembly described herein (e.g., 317, FIG. 3A). While it need not be exactly the same, the tension mandrel 616 may include various features and components like that of tension mandrel 316, and thus components thereof may be duplicate or analogous.

The tension mandrel 616 may be of any suitable shape, such as generally cylindrical or comparable. The tension mandrel 616 may be made of any material known for durability in wellbore operations, such as cast iron or steel. Although not limited, the tension mandrel 616 may be a solid body.

The tension mandrel 616 may have an upper mandrel end 615 configured for coupling with a lower end of a power charge mandrel (not shown here). The coupling may be securable, such as via threads 651*a* and/or use of set screws.

The tension mandrel 616 may have a lower end 618 configured for coupling with another component, such as an adapter (352) or directly to a downhole tool (302). The mandrel end 618 may be configured for threadingly attaching to another threaded member via threads 651*b*, such as with a universal coupling adapter (which may then connect with a downhole tool). Threads include stub acme, buttress, and the like. In addition to threads, one or more set screws or other retainer mechanism may be screwed into recess region(s).

The mandrel 616 may have generally continuous outer diameter D1. The outer diameter D1 may accommodate the sliding engagement of an inner diameter ID1 of a barrel piston surface (see FIGS. 3B-3C). A portion of the mandrel 616 may have a flared or belled surface 618*a*, essentially being a part of the mandrel 616 that has a diameter D2 of some size greater than D1 (of outer tension mandrel surface 620). The flared end surface 618*a* may have a length L1 to which the diameter D2 may be varied along the length L1.

The flared end surface 618*a* may provide a deceleration effect as the barrel piston (e.g., 376) engages therewith during setting.

Advantages

Embodiments herein may provide the advantage of having a direct coupling of the setting tool to the plug, versus using a traditional wireline adapter kit. This allows for better reliability since there is not an additional linking mechanism.

Of significance, embodiments herein provide for a setting tool that does not require or is void of a liquid timer/shock absorber built in feature. Conventional setting tools, such as the Baker, require oil to move from one chamber to a second chamber through a small orifice as it pertains to the setting time. The setting tool of the disclosure does not require any liquid displacement for timing/shock absorbing purposes.

Embodiments herein also alleviate need the need of a retainer ring. The setting tool may beneficially shorter. A shorter setting tool can easily pass through tight wellbore doglegs. A smaller number of parts and elimination of liquids required for the setting tool to operate properly increase tool reliability. The shorter tool also allows more perforating guns to be run above the plug as a result of surface lubricator limitations.

While preferred embodiments of the disclosure have been shown and described, modifications thereof can be made by one skilled in the art without departing from the spirit and teachings of the disclosure. The embodiments described herein are exemplary only, and are not intended to be limiting. Many variations and modifications of the disclosure disclosed herein are possible and are within the scope of the disclosure. Where numerical ranges or limitations are expressly stated, such express ranges or limitations should be understood to include iterative ranges or limitations of like magnitude falling within the expressly stated ranges or limitations. The use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, and the like.

Accordingly, the scope of protection is not limited by the description set out above but is only limited by the claims which follow, that scope including all equivalents of the subject matter of the claims. Each and every claim is incorporated into the specification as an embodiment of the present disclosure. Thus, the claims are a further description and are an addition to the preferred embodiments of the present disclosure. The inclusion or discussion of a reference is not an admission that it is prior art to the present disclosure, especially any reference that may have a publication date after the priority date of this application. The disclosures of all patents, patent applications, and publications cited herein are hereby incorporated by reference, to the extent they provide background knowledge; or exemplary, procedural or other details supplementary to those set forth herein.

What is claimed is:

1. A method of using a combination downhole assembly in a wellbore, the method comprising:

running a workstring into the wellbore to a desired location, the workstring comprising the combination downhole assembly coupled therewith, the combination downhole assembly further comprising:

a setting tool assembly, wherein the setting tool assembly further comprises:

a head adapter coupled with the workstring;

a power charge mandrel having an upper end and a lower end, the upper end coupled with the head adapter, the power charge mandrel further comprising an inner charge bore with a power charge disposed therein, wherein the inner charge bore is open at the upper end, and the inner charge bore is closed via a blind end at the lower end, and wherein the lower end further comprises a plurality of ports arranged entirely axially longitudinally and in parallel with a longitudinal axis of the power charge mandrel;

wherein the inner charge bore has a first inner bore diameter at the upper end, wherein the inner charge bore has a transition region that flares outward at the lower end from the first inner bore diameter to a second inner bore diameter that is larger than the first inner bore diameter;

a barrel piston releasably coupled with the power charge mandrel;

a tension mandrel disposed, at least partially, within the barrel piston, the tension mandrel also coupled with the lower end of the power charge mandrel, and wherein a pressure chamber is accessible between the power charge mandrel and the tension mandrel;

a downhole tool coupled with the setting tool assembly;

a setting sleeve having a first setting sleeve end coupled with the barrel piston via one or more securing members, and a second setting sleeve end coupled with the downhole tool;

causing an activation signal to transmit in a manner to activate the setting tool assembly, whereby the power charge burns to create an increase in fluid pressure within the pressure chamber sufficient to move the barrel piston, wherein the barrel piston comprises a barrel piston end having an inner barrel piston diameter, wherein the tension mandrel comprises a tension mandrel end having an outer tension mandrel diameter, and wherein the outer tension mandrel diameter is larger than the inner barrel piston diameter.

2. The method of claim 1, wherein the barrel piston is releasably coupled to the power charge mandrel with one or more shearing devices, and wherein the one or more shearing devices shear in a range of 2000 lbf to 8000 lbf, and upon release, thereafter the downhole tool begins to set.

3. The method of claim 1, wherein the barrel piston end engages and bottoms out on the tension mandrel end upon a stroke of the setting tool assembly that is driven by the fluid pressure generated by burning the power charge.

4. The method of claim 3, wherein the setting tool assembly is void of a retainer ring, and wherein the tension mandrel is coupled with the downhole tool via an adapter.

5. The method of claim 3, wherein neither the power charge, nor the inner charge bore, extend past the blind end.

6. The method of claim 1, the method further comprising:

pre-assembling the setting tool assembly with the downhole tool to form the combination assembly, the pre-assembly occurring at a location at least 10 miles away from a worksite where the wellbore is located; and delivering the pre-assembled combination unit to the worksite.

7. The method of claim 1, wherein the setting sleeve is made of a composite material.

8. A method of using a combination downhole assembly in a wellbore formed at a worksite, the method comprising:

running a workstring into the wellbore to a desired location, the workstring comprising the combination downhole assembly coupled therewith, the combination downhole assembly further comprising:

a setting tool assembly, wherein the setting tool assembly further comprises:

a head adapter coupled with the workstring;

a power charge mandrel coupled with the head adapter, the power charge mandrel having an upper end, a lower end, and an inner charge bore with a power charge disposed therein, wherein the inner charge bore is open at the upper end, and the inner charge bore is closed via a blind end at the lower end, and wherein the lower end further comprises a plurality of ports arranged entirely axially longitudinally and in parallel with a longitudinal axis of the power charge mandrel;

a barrel piston releasably coupled with the power charge mandrel;

a tension mandrel disposed, at least partially, within the barrel piston, and wherein a pressure chamber is accessible between the power charge mandrel and the tension mandrel;

a downhole tool coupled with the setting tool assembly;

a setting sleeve having a first setting sleeve end coupled with the barrel piston via one or more securing members, and a second setting sleeve end coupled with the downhole tool;

causing an activation signal to transmit in a manner to activate the setting tool assembly, whereby the power charge burns to create an increase in fluid pressure within the pressure chamber sufficient to move the barrel piston;

pre-assembling the setting tool assembly with the downhole tool to form the combination assembly, the pre-assembly occurring at a location at least 10 miles away from the worksite; and delivering the pre-assembled combination unit to the worksite, wherein the inner charge bore has a first inner bore diameter at the upper end, wherein the inner charge bore has a transition region that flares outward at the lower end from the first inner bore diameter to a second inner bore diameter that is larger than the first inner bore diameter.

9. The method of claim 8, wherein the barrel piston comprises a barrel piston end having an inner diameter, wherein the tension mandrel comprises a tension mandrel end having an outer diameter, and wherein the outer diameter is larger than the inner diameter.

10. The method of claim 9, wherein the barrel piston is releasably coupled to the power charge mandrel with one or more shearing devices, and wherein the one or more shearing devices shear in a range of 2000 lbf to 8000 lbf, and upon release, thereafter the downhole tool begins to set.

11. The method of claim 10, wherein the setting tool assembly is void of a retainer ring, wherein the setting sleeve is made of a composite material, and wherein the tension mandrel is coupled with the downhole tool via an adapter.

12. A combination downhole assembly for use in a wellbore, the combination assembly comprising:

a setting tool assembly, wherein the setting tool assembly further comprises:

a head adapter coupled with the workstring;

a power charge mandrel having an upper end and a lower end, the upper end coupled with the head adapter, the power charge mandrel further comprising an inner charge bore with a power charge disposed therein, wherein the inner charge bore is open at the upper end, and the inner charge bore is closed via a blind end at the lower end, and wherein the lower end further comprises a plurality of ports arranged entirely axially longitudinally and in parallel with a longitudinal axis of the power charge mandrel;

a barrel piston releasably coupled with the power charge mandrel, the barrel piston comprising a working surface;

a tension mandrel disposed, at least partially, within the barrel piston, and the tension mandrel also coupled with the lower end of the power charge mandrel;

a downhole tool coupled with the setting tool assembly;

a setting sleeve having a first setting sleeve end coupled with the barrel piston via one or more securing members, and a second setting sleeve end coupled with the downhole, wherein neither the power charge, nor the inner charge bore, extend past the blind end, wherein the inner charge bore has a first inner bore diameter at the upper end, wherein the inner charge bore has a transition region that flares outward at the lower end from the first inner bore diameter to in a second inner bore diameter that is larger than the first inner bore diameter.

13. The combination assembly of claim 12, wherein during operation thereof, an activation signal is transmitted in a manner to activate the setting tool assembly, whereby the power charge burns to create an increase in fluid pressure within the pressure chamber sufficient to act on the working surface, and to resultantly move the barrel piston.

14. The combination assembly of 13, wherein the working surface has a surface area in a surface area range of about 4 square inches to about 8 square inches, and wherein the securing members comprise dry pins.

15. The combination assembly of claim 12, wherein the barrel piston is releasably coupled to the power charge mandrel with one or more shearing devices, and wherein the one or more shearing devices is configured to shear in a range of 2000 lbf to 8000 lbf, and upon release, thereafter the downhole tool begins to set.

16. The combination assembly of claim 15, wherein the barrel piston comprises a barrel piston end having an inner diameter, wherein the tension mandrel comprises a tension mandrel end having an outer diameter, and wherein the outer diameter is larger than the inner diameter.

17. The combination assembly of claim 12, wherein the setting tool assembly is void of a retainer ring, and wherein the setting sleeve is made of a composite material.

18. The combination assembly of claim 17, wherein the tension mandrel is coupled with the downhole tool via an adapter, wherein the setting tool assembly is pre-assembled with the downhole tool to form the combination assembly, and wherein the pre-assembly occurs at a location at least 10 miles away from a worksite where the wellbore is located.

* * * * *